US005090426A

United States Patent [19]

Tang et al.

[11] Patent Number: 5,090,426

[45] Date of Patent: Feb. 25, 1992

[54] SMOKING ARTICLE

[75] Inventors: Jiunn-Yann Tang; Li-Chung Chao, both of Louisville, Ky.

[73] Assignee: Brown & Williamson Tobacco Corporation, Louisville, Ky.

[21] Appl. No.: 324,137

[22] Filed: Mar. 16, 1989

[51] Int. Cl.[5] ..... A24D 1/00; A24D 1/02; A24D 1/18

[52] U.S. Cl. ..... 131/194; 131/359; 131/364; 131/335

[58] Field of Search ..... 131/198.1, 194, 196, 131/198.2, 359, 369

[56] References Cited

U.S. PATENT DOCUMENTS 4,474,191 10/1984 Steiner ..... 131/198.2
4,771,795 9/1984 White et al. ..... 131/364

*Primary Examiner*—V. Millin
*Attorney, Agent, or Firm*—Charles I. Sherman

[57] ABSTRACT

A smoking article comprising a cylinder of a first fuel, and a sleeve of a second fuel concentrically surrounding and longitudinally coextensive with the cylinder. A filter plug is coaxially located at one end of the sleeve and a seal is located at the interface of the filter and sleeve. In another embodiment, a tube is coaxially located at one end of the sleeve to define a chamber, and a filter is coaxially located at one end of the tube.

9 Claims, 1 Drawing Sheet

SMOKING ARTICLE

BACKGROUND OF THE INVENTION

1. Field of the Invention

The present invention relates to smoking articles or devices, and more particularly, to a smoking article having a sleeve of one fuel composition and a cylinder of another fuel composition concentrically located within the sleeve concentrically located within the sleeve.

Smoking devices having two different concentrical fuel elements are per se known. Such smoking devices are taught in the following patents.

European Patent Application No. 0 245 732, filed on May 2, 1987 by R. J. Reynolds Tobacco Company and claiming priority to the May 15, 1980 filing date of U.S. patent application Ser. No. 863,646, teaches a smoking article having two concentric fuel segments having a different burn rate with a metal tube concentrically located inside the inner fuel tube. The metal tube is filled with a substrate which includes an aerosol forming substance. A filter is attached to one end of the smoking article with a seal between the filter and the fuel segments so that only the substrate is inside the metal tube.

U.S. Pat. No. 3,258,015, issued on June 28, 1966 to C. D. Ellis teaches a smoking device having a cylindrical tobacco rod with a metal tube coaxially extending through the tobacco rod. A nicotine releasing material such as tobacco fills the metal tube.

U.S. Pat. No. 3,356,094, issued on Dec. 5, 1967 to C. D. Ellis is a modification of the smoking device of U.S. Pat. No. 3,258,015 and teaches a smoking device having a cylindrical tobacco rod with a frangible tube extending through the tobacco rod. The inside surface of the tube is coated with a nicotine releasing material.

SUMMARY OF THE INVENTION

The present invention provides a smoking article having a cylinder of one fuel concentrically surrounded by a sleeve of another fuel.

More particularly, the present invention provides a smoking article comprising a cylinder of a first fuel, a sleeve of a second fuel concentrically surrounding the first fuel cylinder and having a length coextensive with the first fuel cylinder, a filter rod coaxially located at one end of the cylinder and sleeve, and a seal located at the interface of the filter and second fuel sleeve.

In another embodiment, the present invention provides a smoking article comprising a cylinder of a first fuel, a sleeve of a second fuel concentrically surrounding the first fuel cylinder and having a length coextensive with the first fuel cylinder, a chamber coaxially located at one end of the cylinder and sleeve, a seal located at the interface of the chamber and second fuel sleeve, and a filter coaxially located at the other side of the chamber.

BRIEF DESCRIPTION OF THE DRAWINGS

A better understanding of the present invention will be had upon reference to the following description in conjunction with the accompanying drawings wherein like numerals refer to like parts throughout the several views and wherein.

DETAILED DESCRIPTION OF THE PREFERRED EMBODIMENTS

Figure 1:
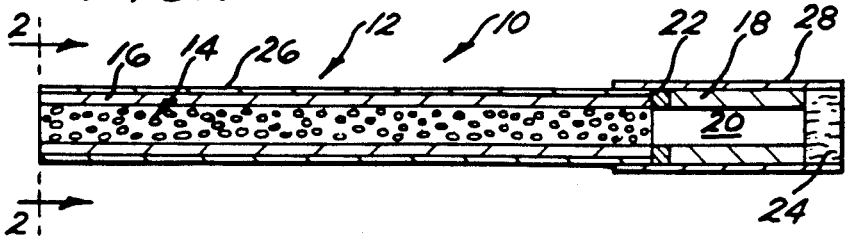
FIG. 1 is a longitudinal cross-sectional view of one embodiment of a smoking article of the present invention.
Figure 2:
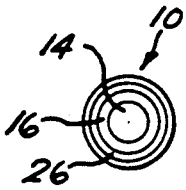
FIG. 2 is an end view of the embodiment of FIG. 1 as seen in the direction of arrows 2—2 in FIG. 1.

With reference to FIGS. 1–2, there is shown a smoking article, generally denoted as the numeral 10.

The smoking article 10 includes a cylindrical body, generally denoted as the numeral 12, which is made up of a cylinder 14 of an aerosol-flavor generating compound and a sleeve 16 of a heat generating material which concentrically surrounds and is longitudinally coextensive with the aerosol-flavor generating cylinder 14, the aerosol-flavor generating compound having a cross-section substantially filling the interior of the sleeve 16. A tube 18 is coaxially located at one end of the cylindrical body 12 defining a cooling chamber 20, and a seal 22 is located at the interface of the chamber defining tube 18 and the heat generating sleeve 16. A low efficiency filter rod 24 is located at the outlet end of the chamber 20 opposite the inlet end of the chamber from the cylindrical body 12. The cylindrical body 12 can be circumscribed by conventional cigarette wrapping paper 26, and is preferably of low air permeability. The filter rod 24 can be secured to the chamber defining tube 18, and the tube 18 can be secured to the cylindrical body 12 by conventional tipping material 28 which surrounds the tube 18 and filter rod 24 and circumferentially overlaps the wrapped cylindrical body 12 proximate the interface of the tube 18 and cylindrical body 12.

With continued reference to FIGS. 1 and 2, the aerosol-flavor generating compound of the cylinder 14 comprises a mixture of a heat absorber material, a flavor releasing material, an aerosol generating material, and any suitable binder material. The heat absorber material may be a metal oxide such as alumina or magnesium oxide. The flavor releasing material can be a tobacco, tobacco powder or a tobacco extract. The aerosol generating material may be propylene gylcol, glycerine, and the like or a combination thereof. Various materials can be used as a binder, for example NaCMC. The aerosol-flavor generating compound of the cylinder 14 is porous for the passage therethrough of air as the smoker draws on the filter end of the smoking article 10.

The heat generating material of the sleeve 16 comprises a mixture of charcoal particles, or a homogeneous mixture of charcoal particles and tobacco. Various burn or smoldering modifier materials can be included with the second fuel. Suitable various burn or smoldering modifier materials include potassium carbonate, sodium, potassium citrate, sodium nitrate, or potassium nitrate. The heat generating material can also contain heat absorbing materials such as metal oxides and silicates. Some examples of metal oxides are aluminum or magnesium oxide. An example of silicate is aluminum silicate.

The cylinder 14 and sleeve 16 can be molded, or preferably extruded. Most advantageously, the cylinder 14 and sleeve 16 are coextruded.

In use of the smoking article 10, the smoker ignites the heat generating material of the sleeve 16. The heat absorbing material of the aerosol-flavor generating compound of the cylinder 14 absorbs sufficient heat to prevent the aerosol-flavor generating compound from igniting while allowing the aerosol-flavor generating compound to char. The absorbed heat causes the flavorants of the flavor releasing material and the aerosol generating material to volatilize for passage along the porous cylinder 14 to the cooling chamber 20. The cooled aerosol and vaporized flavorants then pass from the cooling chamber 20, through the filter 24 and into the smoker's mouth.

Figure 3:
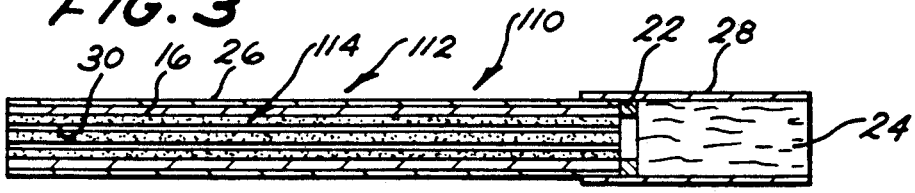
FIG. 3 is a longitudinal cross-sectional view of another embodiment of the invention similar in most respects to the embodiment of FIG. 1.

Now with reference to FIG. 3, there is shown a somewhat different embodiment of a smoking article 110 which has many features in common with the smoking article 10 of FIGS. 1 and 2. Therefore, in the FIGS. 1 and 3, identical features are denoted by identical numerals and the description thereof will not be repeated for the sake of brevity. The smoking article 110 is identical to the smoking article 10 except that the smoking article 110 does not have a cooling chamber 20, and the aerosol-flavor generating compound of the cylinder 114 is not porous.

In the smoking article 110, the filter rod 24 abuts the end of the cylindrical body 12 with the seal 22 at the interface of the sleeve 16 and filter 24. To provide for the flow of air through the non-porous cylinder 14, longitudinally extending air flow passages 30 open at both ends of the fuel cylinder 14 are provided.

Figure 4:
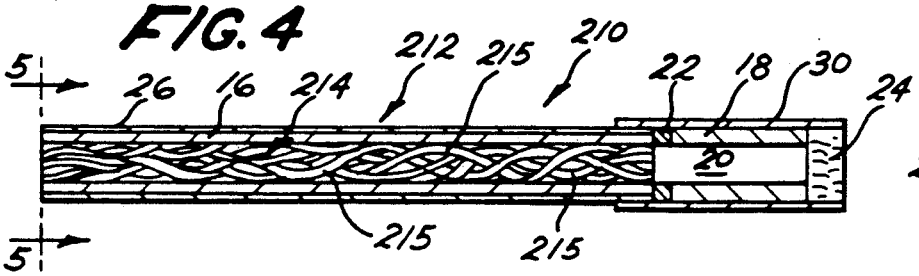
FIG. 4 is a longitudinal cross-sectional view of a further embodiment of the present invention.
Figure 5:
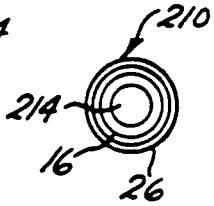
FIG. 5 is an end view of the embodiment of FIG. 4 as seen in the direction of arrows 5—5 in FIG. 4.

Now with reference to FIGS. 4 and 5, there is shown a smoking article, generally denoted as the numeral 210. The smoking article 210 includes many features in common with the smoking article 10, and, therefore, in FIGS. 1 and 4, identical features are denoted by identical numerals and the description thereof will not be repeated for the sake of brevity. The smoking article 210 is identical to the smoking article 10 except for the physical construction of the aerosol-flavor generating cylinder which is denoted by the numeral 214 in FIGS. 4 and 5 to differentiate it from the cylinder 14 of FIGS. 1 and 2, and the cylinder 114 of FIG. 3. In the smoking article 210, the cylinder 214 is formed of a plurality of strands 215 fabricated of the aerosol-flavor generating compound as described above in regard to the cylinder 14 of the smoking article 10. The strands 215 extend generally longitudinally of the sleeve 16 and are intertwined in a random array so that the interstices of the intertwined strands 215 provide a sinuous flow path for air drawn therethrough as a smoker draws on the filtered end of the smoking article 210.

Figure 6:
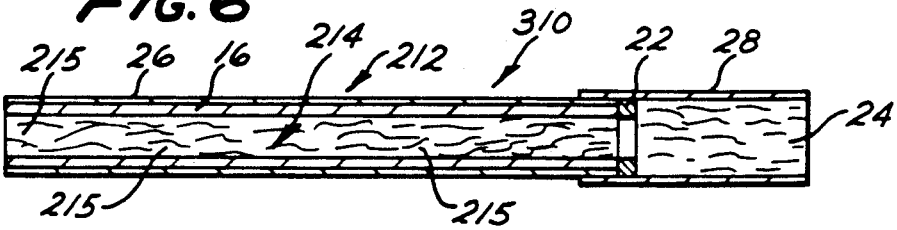
FIG. 6 is a longitudinal cross-sectional view of another embodiment of the invention similar in most respects to the embodiment of FIG. 4.

Now with reference to FIG. 6, there is shown a somewhat different embodiment of a smoking article 310 which has many features in common with the smoking article 110 of FIG. 3. Therefore, in FIG. 6, identical features are denoted by identical numerals and the description thereof will not be repeated for the sake of brevity. The smoking article 310 is identical to the smoking article 110 except the smoking article 310 incorporates the cylinder 214 formed of a plurality of intertwined, longitudinally extending strands 215 of the aerosol-flavor generating compound used with the smoking article 210 of FIGS. 4 and 5.

Figure 7:
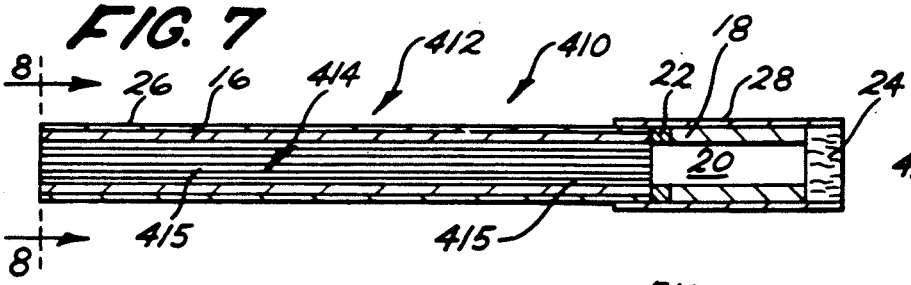
FIG. 7 is a longitudinal cross-section view of yet another embodiment of a smoking article of the present invention.
Figure 8:
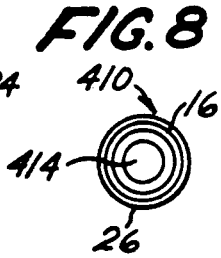
FIG. 8 is an end view of the embodiment of FIG. 7 as seen in the direction of arrows 8—8 in FIG. 7; and, FIG. 9 is a longitudinal cross-sectional view of a further embodiment of the invention similar in most respects to the embodiment of FIG. 7.

With reference to FIGS. 7 and 8, there is shown a further embodiment of a smoking article 410 which has many features in common with the smoking article 10 of FIGS. 1 and 2, and the smoking article 210 of FIGS. 4 and 5. The features common between the smoking article 410 and smoking articles 10 and 210 are denoted by identical numerals in the Figures and the description thereof will not be repeated for the sake of brevity. The smoking article 410 is identical to the smoking articles 10 and 210 except for the physical construction of the cylinder which is denoted by the numeral 414 in FIGS. 7 and 8 to differentiate it from the cylinder 14 of FIGS. 1 and 2 and the cylinder 214 of FIGS. 4 and 5. In the smoking article 410, the cylinder 414 is formed of a plurality of strands 415 fabricated of the aerosol-flavor generating compound as described above in regard to the cylinder 14 of the smoking article 10. The fuel strands 415 extend longitudinally of the sleeve 16, but unlike the strands 215 of the embodiment of FIGS. 4, 5, and 6, the strands 415 are not intertwined but are disposed in closely packed generally parallel relationship to each other so that the interstices of the parallel extending strands 415 provide a relatively straight flow path for air drawn therethrough as a smoker draws on the filtered end of the smoking article 410.

Figure 9:
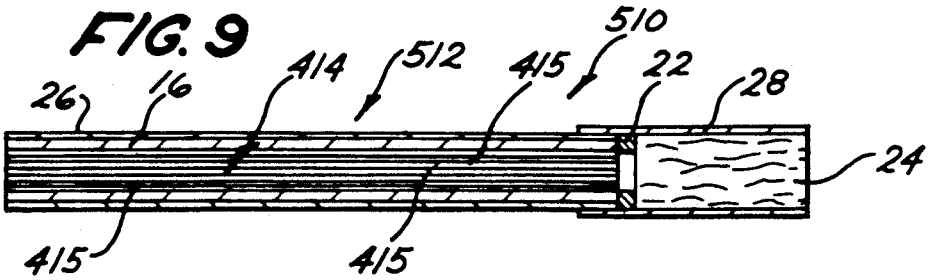

Now with reference to FIG. 9, there is shown another embodiment of a smoking article 510 which has many of its features in common with the smoking article 110 of FIG. 3. Therefore, in FIG. 9, identical features are denoted by identical numerals and the description thereof will not be repeated for the sake of brevity. The smoking article 510 is identical to the smoking article 110 except the smoking article 510 incorporates the fuel cylinder 414 of the plurality of generally parallel aerosol-flavor generating compound strands 415 used with the smoking article 410 of FIGS. 7 and 8.

The foregoing detailed description is primarily given for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A smoking article comprising:

a sleeve of a heat generating material wherein the sleeve wall is air impermeable;

a cylinder of an aerosol-flavor generating compound concentrically located within the sleeve co-extensive therewith and substantially filling the cross-section of the interior of the sleeve, the cylinder being air permeable along its cylindrical wall length, the aerosol-flavor generating compound comprising an inert metal oxide as a heat sink homogeneously mixed with the other components of the cylinder;

a tube coaxially located at one end of the sleeve and cylinder with the wall of the tube being about the same thickness as the sleeve; and, a filter coaxially located at the distal end of the tube.

2. The smoking article of claim 1, wherein the heat generating material of the sleeve comprises charcoal.

3. The smoking article of claim 2, wherein the heat generating material of the sleeve further comprises tobacco homogeneously mixed with the charcoal.

4. The smoking article of claim 1, wherein the aerosol-flavor generating compound of the cylinder comprises a flavor releasing material and an aerosol generating material.

5. The smoking article of claim 4, wherein the flavor releasing material comprises tobacco.

6. A smoking article comprising:

a sleeve of a heat generating material wherein the sleeve wall is air impermeable;

a cylinder of an aerosol-flavor generating compound concentrically located within the sleeve co-extensive therewith and substantially filling the cross-section of the interior of the sleeve, the cylinder being air impermeable along its cylindrical wall length, the aerosol-flavor generating compound comprising an aluminum silicate as a heat sink homogeneously mixed with the other components of the cylinder;

a tube coaxially located at one end of the sleeve and cylinder with the wall of the tube being about the same thickness as the sleeve; and, a filter coaxially located at the distal end of the tube.

7. A smoking article comprising:

a sleeve of a heat generating material wherein the sleeve wall is air impermeable;

a cylinder of an aerosol-flavor generating compound concentrically located within the sleeve and co-extensive therewith, comprised of a plurality of strands of the aerosol-flavor generating compound, and the interstices of strands provide for the path of air to be drawn through the cylinder;

a tube coaxially located at one end of the sleeve and cylinder with the wall of the tube being about the same thickness as the sleeve; and, a filter coaxially located at the distal end of the tube.

8. The smoking article of claim 1, wherein the strands of the aerosol-flavor generating compound are disposed in mutual parallel relationship extending longitudinally of the cylinder, and the interstices of the strands define substantially straight air flow passages through the cylinder.

9. The smoking article of claim 8, wherein the strands of the aerosol-flavor generating compound are intertwined extending generally longitudinally of the cylinder, and the interstices of the strands define sinous air flow passages through the cylinder.

* * * * *

UNITED STATES PATENT AND TRADEMARK OFFICE

CERTIFICATE OF CORRECTION

PATENT NO. : 5,090,426

DATED : February 25, 1992

INVENTOR(S) : Jiunn-Yann Tang, et al

It is certified that error appears in the above—identified patent and that said Letters Patent is hereby corrected as shown below:

In Claim 8, column 6, line 15 of the Patent, replace the number "1" with --7--.

Signed and Sealed this

Twenty-third Day of November, 1993

*Attest:*

*Attesting Officer*

Bruce Lehman

BRUCE LEHMAN

*Commissioner of Patents and Trademarks*